US005165596A

United States Patent [19]

Le Mer

[11] Patent Number: 5,165,596

[45] Date of Patent: Nov. 24, 1992

[54] DUAL-PURPOSE CENTRAL HEATING BOILERS

[75] Inventor: Joseph Le Mer, St Thegonnec, France

[73] Assignee: Chaffoteaux et Maury, France

[21] Appl. No.: 726,193

[22] Filed: Jul. 5, 1991

[30] Foreign Application Priority Data

Jul. 13, 1990 [FR] France ..... 90 08961

[51] Int. Cl.[5] ..... F24H 9/12

[52] U.S. Cl. ..... 237/8 R; 237/19; 237/70; 137/884; 137/557

[58] Field of Search ..... 237/19, 8 R, 70, 71; 137/884, 557

[56] References Cited

U.S. PATENT DOCUMENTS 4,657,047 4/1987 Kolibas ..... 137/884 X
5,076,494 12/1991 Ripka ..... 237/19

FOREIGN PATENT DOCUMENTS 700485 6/1967 Belgium .
1334629 7/1963 France .
2082328 12/1971 France .
2398271 2/1979 France .

*Primary Examiner*—Arnold Rosenthal
*Attorney, Agent, or Firm*—Larson and Taylor

[57] ABSTRACT

The connection strip is for use with a dual-purpose hot water and central heating boiler. The strip comprises four modules made of molded hard plastic and assembled side-by-side by being mutually juxtaposed with tie bars passing through them, the modules being respectively associated with outgoing heating water, outgoing domestic hot water, incoming cold water, and returned heating water, each module including the corresponding stopcocks and ducts together with lengths of a short-circuit duct enabling the modules to co-operate to form a short-circuit on the heating circuit, suitable for feeding water to said heating circuits and for enabling leak tests to be performed when the boiler is not present.

9 Claims, 3 Drawing Sheets

FIG.1.
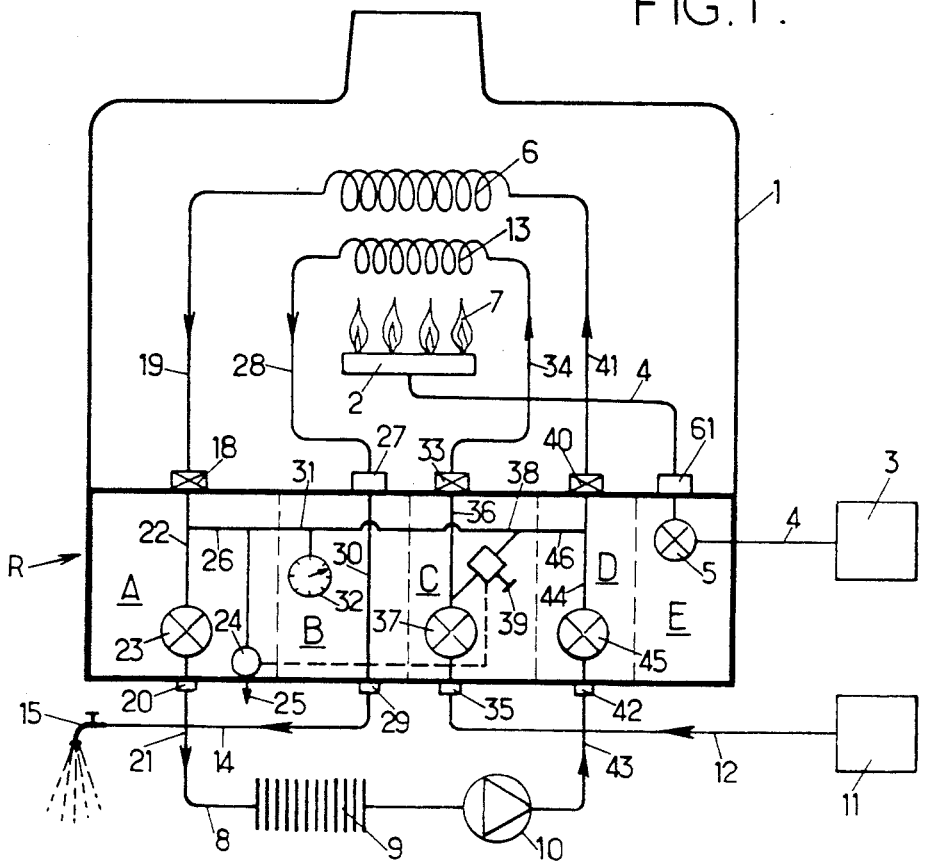
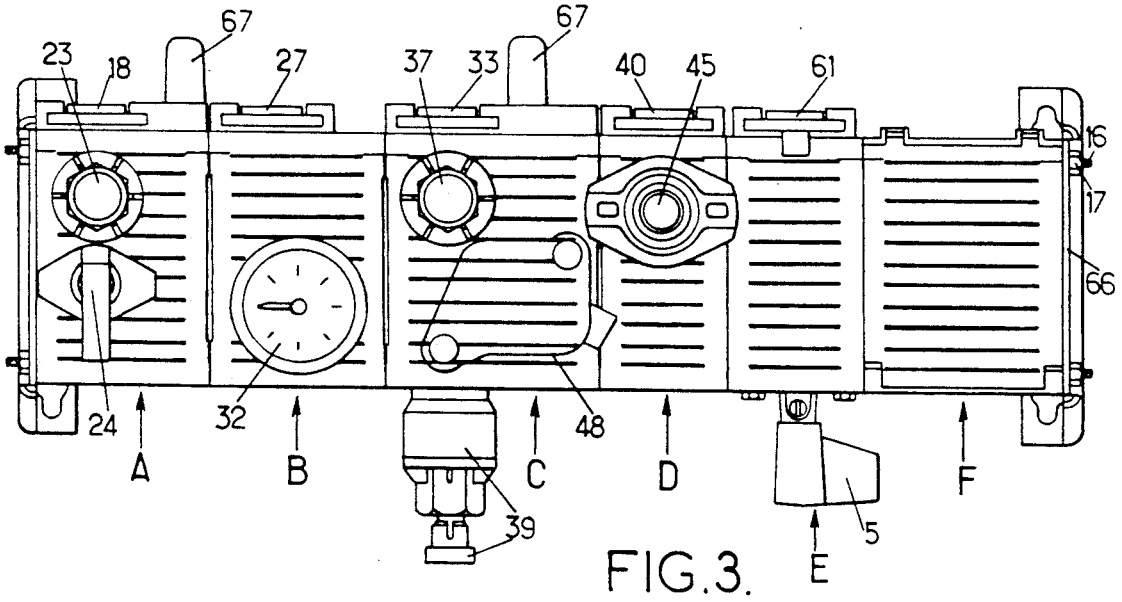
FIG.3.

DUAL-PURPOSE CENTRAL HEATING BOILERS

FIELD OF THE INVENTION

The invention relates to dual-purpose central heating boilers, i.e. to devices for heating water in two circuits, one for providing central heating by circulating hot water through radiators or the like, and the other for providing hot water to be drawn off for the purposes of washing, cooking, . . . , and referred to as "domestic" water, with the heat necessary for heating the water preferably being generated by burning a gaseous fuel.

The invention relates more particularly to portions for connecting such boilers to external pipework for feeding the boiler with cold water or with warm water and for taking hot water therefrom.

BACKGROUND OF THE INVENTION

In prior embodiments of such devices, it is necessary to interpose a whole series of accessories between the boiler as delivered from the factory and the external pipework therefor, particularly to make it possible to feed circuits with water under pressure (generally coming from an outside water main), and to provide respective stopcocks for each of these circuits, together safety precautions concerning excess pressure or leaks.

In addition, with such embodiments, it is not generally possible to apply pressure to the central heating circuit comprising the radiators for the purpose of leak testing until the boiler is installed: this constitutes a drawback while the premises to be fitted is still being built and is therefore not protected against theft or damage.

The invention enables these drawbacks to be remedied, and to this end it proposes that the connection portions for boilers of the type in question should be constituted by special "strips" which are particularly simple and cheap to make, which strips make it possible to test the central heating circuit under pressure in the absence of the boiler per se, i.e. in the absence of the active portion of the boiler comprising its burner and its heat exchangers.

SUMMARY OF THE INVENTION

To this end, the invention provides a connection portion of the type in question and essentially comprising:

four molded modules assembled side-by-side by mutual juxtaposition and by common tie bars passing therethrough and preferably including threaded ends cooperating with clamping nuts;

wherein the first module comprises an inlet connectable to outgoing heating pipework of the boiler, an outlet connectable to outgoing heating pipework leading to the radiators, a duct connecting said inlet to said outlet, a manual stopcock mounted on said duct, a safety valve connecting said duct to a drain, and a length of short-circuit suitable for connecting the above duct to the second module;

wherein the second module comprises an inlet connectable to the outgoing domestic hot water pipework of the boiler, an outlet connectable to outgoing domestic hot water pipework for at least one tap for drawing off water, a duct connecting said inlet to said outlet, a length of short-circuit passing through said second module from the first module to the third module, and a pressure gauge connected on said length;

wherein the third module comprises an outlet connectable to the incoming domestic cold water pipework of the boiler, an inlet connectable to the pipework for feeding cold water under pressure from the outside, a duct connecting said inlet to said outlet, a stopcock mounted on said duct, a length of short circuit passing through said third module from the second module to the fourth module, and a barrier member interposed between said last-mentioned length and the last-mentioned duct; and wherein the fourth module comprises an outlet connectable to the return heating pipework of the boiler, an inlet connectable to the return heating pipework coming from the radiators, a duct connecting said inlet to said outlet, a stopcock mounted on said duct, and a length of short-circuit suitable for connecting said duct to the length of short circuit of the third module;

the various modules being organized in such a manner that the various lengths of short circuit included therein are connected end-to-end in watertight manner merely by the four modules being juxtaposed.

In preferred embodiments, use is made of one or more of the following dispositions:

the third module is associated with a safety member which is itself connected to the drain of the first module via respective drain lengths contained in each of the first three modules and automatically connected end-to-end in watertight manner merely by juxtaposing these three modules;

the barrier member of the third module is a valve having two valve members mounted in series between the domestic cold water feed duct and the length of short-circuit in said third module, and said valve is associated with a "disconnector" safety member and with a central compartment connected to the atmosphere and suitable for collecting leaks of water that may occur between the two valve members;

the fourth module includes a delivery valve mounted on the length of short-circuit of said fourth module, said valve being urged towards a closed position by a spring which is rated in such a manner as to open only if pressure loss exceeding a given threshold exists in the heating circuit, e.g. because of thermostatic valves closing;

the stopcock of the fourth module is fitted with a filter that is easily removable when the cock is closed, the filter serving to retain impurities coming from the heating circuit and preventing them being delivered to the heat exchanger of the boiler;

at least one other molded module is assembled against the assembly of the four above-defined modules using the same tie bars that are used for assembling said four modules, namely a fifth module comprising an inlet connectable to pipework providing an outside feed of gas under pressure, an outlet connectable to pipework for feeding the burner of the boiler with gas, a duct connecting said inlet to said outlet, and a stopcock mounted on said duct, and optionally a sixth module for the various electrical connections of the boiler;

each module is made of hard plastic, which plastic may differ from one module to another;

each molded module comprises a prismatic or cylindrical peripheral band whose outline is substantially rectangular with rounded corners, four rectilinear channels being disposed in respective ones of the four corners of said band for receiving the tie bars, and a plurality of rectilinear or bent tubular lengths reinforced by generally plane webs extending perpendicularly to the generator lines of the prism of cylinder defining the band; and the inlets or outlets for connection to the boiler are all disposed on a top face of the strip, and most of the inlets or outlets for connection to external pipework are disposed on the rear face of the strip.

In addition to these main dispositions, the invention includes various other dispositions which are preferably used together and which are described in greater detail below.

BRIEF DESCRIPTION OF THE DRAWINGS

An embodiment of the invention is described by way of example with reference to the accompanying drawings, in which:

FIG. 1 of these drawings shows a dual-purpose central heating boiler in highly diagrammatic form, with the portion of the boiler for connection of external pipework being constituted by a strip made up in accordance with the invention.

FIG. 3 is a front view of the strip.

DETAILED DESCRIPTION

Figure 2:
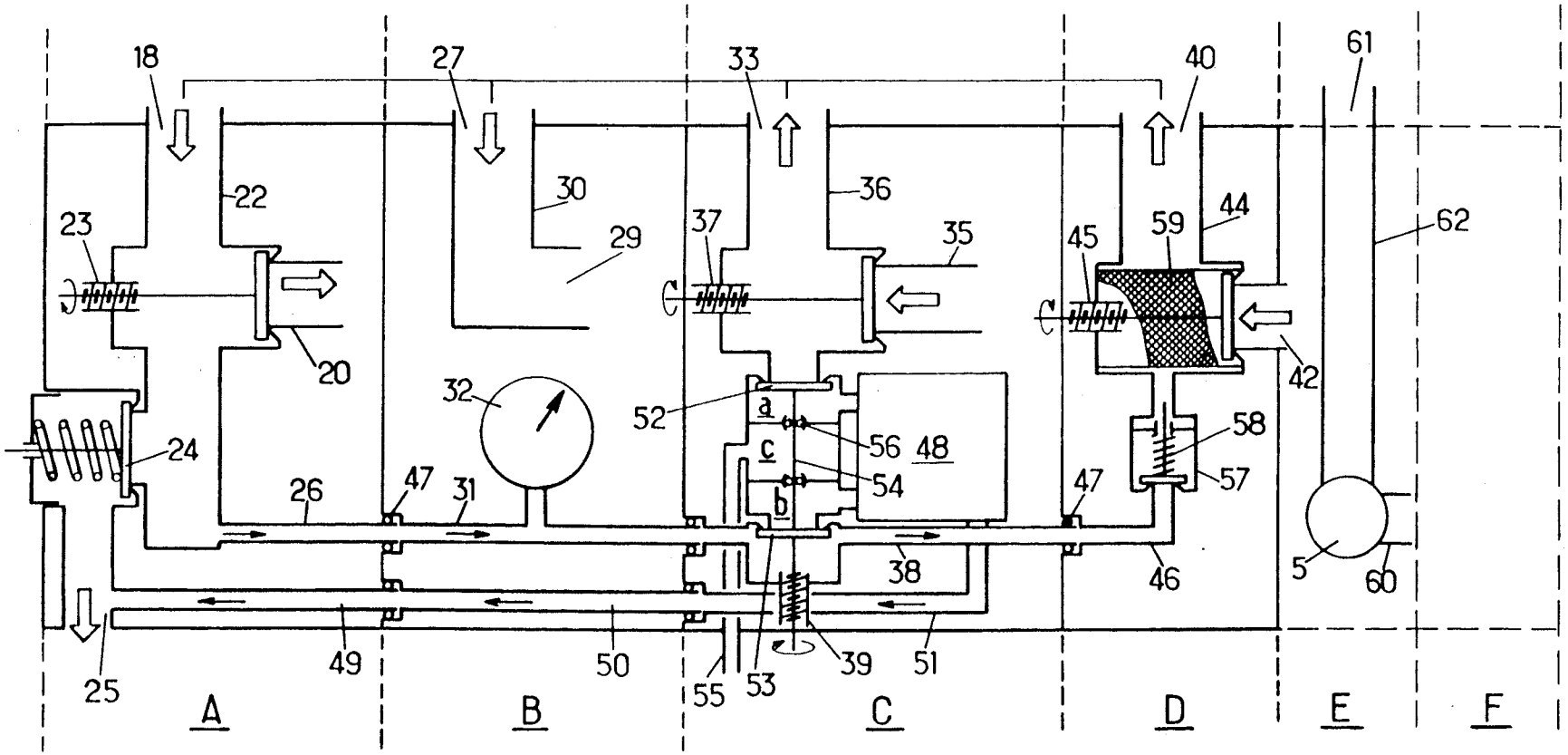
FIG. 2 shows the same strip diagrammatically, but in greater detail.

In conventional manner, the dual-purpose boiler under consideration comprises a housing 1 containing a gas-fired burner 2 fed with gaseous fuel under pressure from mains 3 via a gas pipe 4 associated with safety means (not shown) and a stopcock 5.

The closed circuit for heating comprises, inside the housing 1, a heat exchanger 6 in which circulating water is heated by flames 7 from the burner 2, and outside said housing, pipework 8 passing successively through heating radiators 9 and a circulation pump 10.

Finally, the circuit for drawing off water comprises in succession, starting from an external source 11 of water under pressure and generally constituted by a water main, external supply pipework 12, a heat exchanger 13 inside the housing 1 and also capable of picking up heat produced by the flames 7, and outlet pipework 14 terminated by at least one faucet or tap 15 for drawing off water.

The invention relates essentially to the connection portion R which is interposed between the external pipework 8, 12, and 14, and the internal pipework including the heat exchangers 6 and 13.

In this case, the connection portion R is constituted by a set of modules made of molded plastic which are juxtaposed next to one another and which are assembled together by tie bars 16 advantageously constituted by rods having threaded ends cooperating with clamping nuts 17.

There are at least four of these modules, and they are allocated respectively as follows:

the first module A to outgoing heating water;

the second module B to outgoing domestic hot water;

the third module C to incoming domestic cold water; and the fourth module D to returning heating water.

The first module A comprises an inlet 18 connectable to boiler pipework 19 for outgoing heating water, an outlet 20 connectable to pipework 21 for conveying outgoing heating water to the radiators, a duct 22 connecting said inlet to said outlet, a manual stopcock 23 mounted on said duct, a safety valve 24 connecting said duct 22 to a drain duct 25, and a length of short-circuit 26 suitable for connecting the above duct 22 to the second module B.

The second module B comprises an inlet 27 connectable to boiler pipework 28 for outgoing domestic hot water, an outlet 29 connectable to the pipework 14 for conveying domestic hot water to at least one tap 15, a duct 30 connecting said inlet to said outlet, a length of short-circuit 31 passing through said second module B from the first module A to the third module C, and a pressure gauge 32 connected to said length 31.

The third module C comprises an outlet 33 connectable to boiler pipework 34 for receiving incoming domestic cold water, an inlet 35 connectable to the pipework 12 for supplying cold water under pressure from the outside, a duct 36 connecting said inlet to said outlet, a stopcock 37 mounted on said duct, a length of short-circuit 38 passing through said third module C from the second module B to the fourth module D, and a barrier member 39 interposed between said length 38 and the last-mentioned duct 36.

The fourth module D comprises an outlet 40 connectable to boiler pipework 41 for receiving returning heating water, an inlet 42 connectable to pipework 43 for returning heating water from the radiators, a duct 44 connecting said inlet to said outlet, a stopcock 45 connected on said duct, and a length of short-circuit 46 suitable for connecting said duct 44 to the length of short-circuit 38 in the third module.

These various modules are organized in such a manner that the various lengths of short-circuit 26, 31, 38, and 46 contained in the four modules are interconnected end-to-end in watertight manner merely by juxtaposing the modules.

To this end, the endpieces of the lengths to be connected together are designed to interfit with interposed O-rings 47 received in suitable grooves formed in the outside cylindrical faces of the male endpieces in the various pairs of endpieces.

As a result, merely assembling the four modules A, B, C, and D together makes it possible automatically:

to connect a short-circuit channel 26, 31, 38, 46 between the two openings 18 and 40 which correspond to couplings with the respective ends 19 and 41 of that portion of the closed circuit for heating which passes inside the boiler; and to connect the outside pipework 12 for supplying cold water to the heating circuit merely by opening the barrier member 39 after the stopcock 37 has been opened.

It should be observed that there is no need for the boiler to be installed at this stage, but that it is nevertheless possible to perform leak testing under pressure on that portion of the central heating circuit which is outside the boiler.

This can be done merely by placing three plugs (not shown) respectively in the three openings 18, 33, and 40 of the connection strip R that are represented by crosses in FIG. 1, and then opening the various stopcocks 23, 37, and 45, and the barrier member 39.

This facility for performing leak testing under pressure on the entire central heating closed circuit apart from the portion thereof lying inside the boiler, even when the boiler is not present, constitutes an important advantage of the present invention.

The preferred embodiment illustrated implements various other dispositions, and in particular those described below:

The third module C is associated with a safety member 48 (FIG. 2) organized firstly to enable the heating circuit and more precisely the short-circuit channel 26, 31, 38, 46 to be supplied with water under pressure from the mains, and secondly to make impossible for a portion of the water circulating in the heating circuit, and more precisely in the above-mentioned short-circuit channel to return to the duct 36, and thus to the water mains 11.

This member 48 is connected to the drain duct 25 in the first module via drain lengths 49, 50, and 51 included in respective ones of the first three modules A, B, and C and organized, like the above-described short-circuit length, so as to be automatically connected together end-to-end in watertight manner merely by juxtaposing the three modules concerned.

The barrier member 39 is constituted in this case by a valve having two valve members 52 and 53 connected in series on a common rod 54, and suitable, respectively, for causing the duct 36 to communicate with a compartment a, and for causing the length 38 to communicate with a compartment b, with said rod passing through both of said compartments which are themselves interconnected by the safety member 48.

A third compartment c disposed between the two compartments a and b and likewise having the rod 54 passing therethrough is connected to the atmosphere via a duct 55.

This duct serves to drain away such drops of water as may leak through the seals where the rod 54 passes through the separating partitions, i.e. the partition between the compartments a and c, and the partition between the compartments b and c, which seals are constituted by o-rings 56, or the like.

It should be observed that the two valve members 52 and 53 are closed simultaneously by acting on the single rod 54 only.

Controlling both valve members together constitutes an advantage compared with prior solutions in which the two valve members correspond to two separate stopcocks both of which need to be closed after each occasion on which the central heating installation is connected to water pressure.

The safety member 48, sometimes known as a "disconnector", may be constituted in any conventional manner and does not form part of the present invention.

The member 48 may be incorporated in the module C, or it may be applied thereto, in particular by means of screws.

The fourth module D advantageously includes a delivery valve 57 (FIG. 2) mounted on the length 46, said valve being biased towards its closed position by a spring 58 which is rated so as to enable the valve to open only if pressure loss in the heating circuit exceeds a given threshold, e.g. due to too large a number of thermostatic valves closing.

The stopcock 45 in the fourth module D is advantageously fitted with a filter 59 which is easily removable when the associated cock is closed, which filter serves to retain impurities coming from the heating circuit and to prevent them from passing into the heat exchanger of the boiler.

In addition to the four modules A, B, C, and D corresponding to connections to be made with water circuits, it may be advantageous to add at least one more module on the same ties bars 16 as the above modules.

This applies, for example, to a fifth module E comprising an inlet 60 connectable to the pipe 4 for providing an external feed of gas under pressure, an outlet 61 connectable to the pipe 4 for feeding the burner 2 of the boiler with gas, and a duct 62 interconnecting said inlet to said outlet, with the above-mentioned stopcock 5 being mounted on said duct 62.

This also applies to the sixth module F which is used for the various electrical connections required by the boiler.

The molded material from which the modules are made may differ from one module to another, and it is adapted to operating temperature, such that the modules for conveying a flow of cold water or of cool water (C and D) or for providing electrical connections (F) may be made of lower grade material than the modules for conveying hot water (A and B) or the module for conveying gas (E).

The material may be a metal such as an aluminum alloy, but it is preferably an injected plastic, which has numerous advantages (cheapness, lightness, corrosion resistance, . . . ).

For example, the plastic may be a polyether sulfone (PES), a polyether imide (PEI), or a polyphenylene sulfone (PPS) for the modules A, B, C, D, and F, and also for a peripheral portion of the module E, with an inside portion of said module E that comes directly into contact with the gas then being formed by a metal core.

Alternatively, module E may be entirely made of an epoxy resin.

Advantageously, each molded module comprises a cylindrical or prismatic peripheral band 63 (FIG. 4) whose outline is substantially rectangular with rounded corners, four rectilinear channels 64 disposed in respective ones of the four corners of the band for the purpose of receiving the tie bars 16, and a plurality of bent or rectilinear lengths of tube T reinforced by webs V that are generally plane and that extend perpendicularly to the generator lines of the prism or cylinder defining the band.

Figure 4:
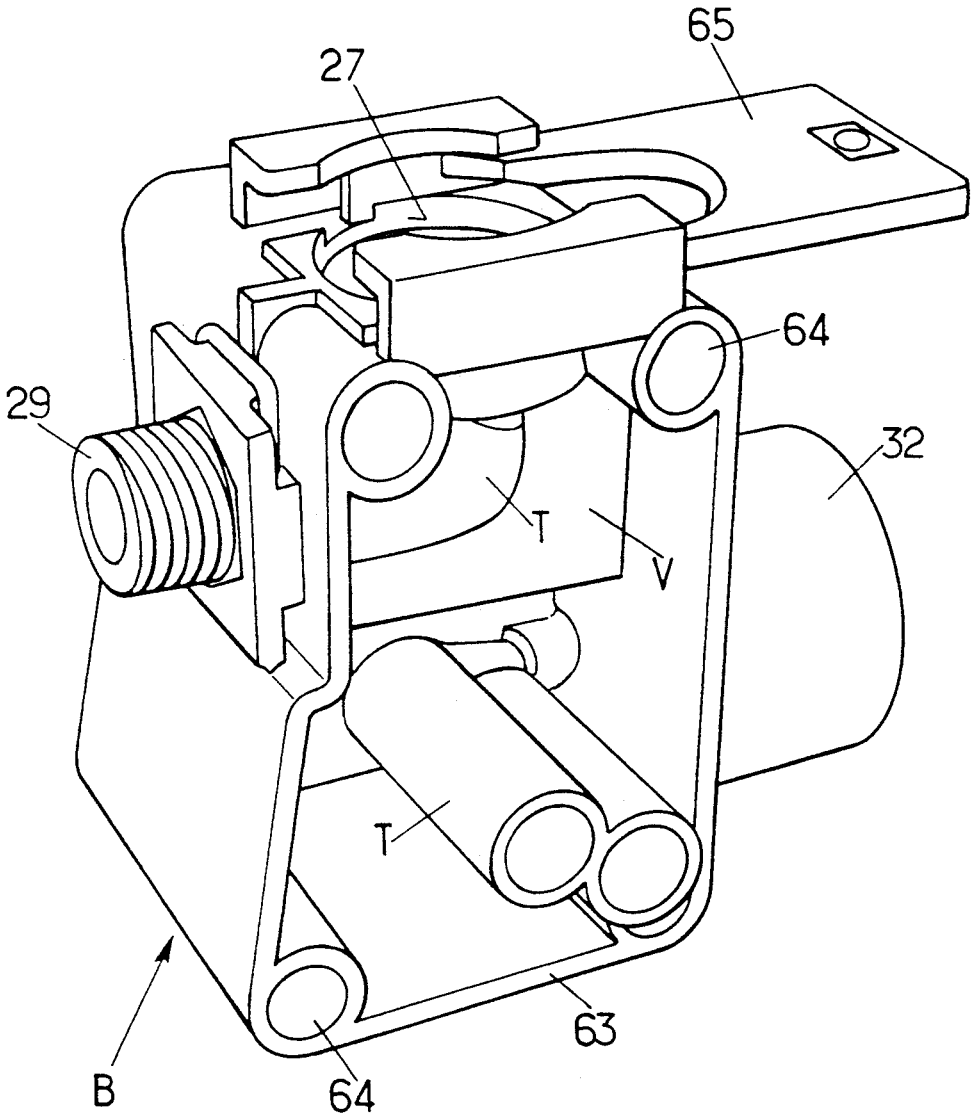
FIG. 4 is a perspective view of one of the component modules of the strip.

The module which is shown on its own and in perspective in FIG. 4 is module B.

As can be seen in the drawings, all of the connections between the strip of valves R and the boiler are disposed on the top face of the strip, whereas most of the connections between the strip and external pipework are on the rear of the strip.

Using such a strip makes it extremely simple to install and remove a boiler.

To this end, the strip R is initially mounted on a wall at a relatively large distance therefrom, e.g. about 20 cm, by means of two metal cheek plates 66 through which the ends of the tie bars 16 pass.

The connections with external pipework 21, 14, 12, 43, and 4 can then easily be established via the waiting inlets and outlets 20, 29, 35, 42, and 60 at the rear of the strip R, i.e. between the strip and the wall, and this may be done, in particular, by means of screw couplings.

Thereafter, the boiler can be connected to the strip R after it has been installed and connected in this way by placing the boiler above the strip, with the endpieces of the lengths of pipework 19, 28, 34, 41, and 4 inside the boiler opening out side-by-side and facing downwards at the bottom of the boiler, with the boiler then being lowered so as to juxtapose appropriate coupling members terminating said endpieces with coupling members weighting for them at 18, 27, 33, 40, and 61, and then finally interconnecting the juxtaposed pairs of couplings.

FIG. 4 shows a clip 65 which facilitates such couplings, which clip is described in the present Applicant's French patent application No. 89 08894.

The above-described lowering of the boiler onto the strip is advantageously guided by pegs 67 provided on the top of the strip co-operating with complementary recesses in the boiler.

In any event, whichever embodiment is adopted, the end result is a strip of cocks and pipework for a dual-purpose central heating boiler, with the structure of the strip being clear from the above.

The use of such a strip presents numerous advantages, and in particular the following:

the central heating circuit can be tested under pressure without the boiler per se being installed;

the boiler is easily installed and removed;

the various items of pipework feeding both circuits of the installation with water under pressure are implemented and connected simply;

the modules are assembled to one another simply; and long service life, good appearance, and cheapness, with cheapness being due in particular to the low cost of the plastic used for making the various modules, even when different plastics are used.

Naturally, and as follows from the above, the invention is not limited to the particular application and implementation that has been more particularly described. On the contrary, the invention extends to any variants thereof.

I claim:

1. A connection strip for a dual-purpose central heating and hot water boiler, wherein the strip comprises four molded modules assembled side-by-side by mutual juxtaposition and by common tie bars passing therethrough;

wherein the first module comprises an inlet connectable to outgoing heating pipework of the boiler, an outlet connectable to outgoing heating pipework leading to the radiators, a duct connecting said inlet to said outlet, a manual stopcock mounted on said duct, a safety valve connecting said duct to a drain, and a length of short-circuit suitable for connecting the above duct to the second module;

wherein the second module comprises an inlet connectable to the outgoing domestic hot water pipework of the boiler, an outlet connectable to outlet domestic hot water pipework for at least one tap for drawing off water, a duct connecting said inlet to said outlet, a length of short-circuit passing through said second module from the first module to the third module, and a pressure gauge connected on said length;

wherein the third module comprises an outlet connectable to the incoming domestic cold water pipework of the boiler, an inlet connectable to the pipework for feeding cold water under pressure from the outside, a duct connecting said inlet to said outlet, a stopcock mounted on said duct, a length of short-circuit passing through said third module from the second module to the fourth module, and a barrier member interposed between said last-mentioned length and the last-mentioned duct; and wherein the fourth module comprises an outlet connectable to the return heating pipework of the boiler, an inlet connectable to the return heating pipework coming from the radiators, a duct connecting said inlet to said outlet, a stopcock mounted on said duct, and a length of short-circuit suitable for connecting said duct to the length of short circuit of the third module;

the various modules being organized in such a manner that the various lengths of short circuit included therein are connected end-to-end in watertight manner merely by the modules being juxtaposed.

2. A connection strip according to claim 1, wherein the third module is associated with a safety member which is itself connected to the drain of the first module via respective drain lengths contained in each of the first three modules and automatically connected end-to-end in watertight manner merely by juxtaposing these three modules.

3. A connection strip according to claim 1, wherein the barrier member of the third module is a valve having two valve members mounted in series between the domestic cold water feed duct and the length of short-circuit in said third module, and wherein said valve is associated with a "disconnector" safety member and with a central compartment connected to the atmosphere and suitable for collecting leaks of water that may occur between the two valve members.

4. A connection strip according to claim 1, wherein the fourth module includes a delivery valve mounted on the length of short-circuit of said fourth module, said valve being urged towards a closed position by a spring which is rated in such a manner as to open only if pressure loss exceeding a given threshold exists in the heating circuit.

5. A connection strip according to claim 1, wherein the stopcock of the fourth module is fitted with a filter that is easily removable when the cock is closed, the filter serving to retain impurities coming from the heating circuit and preventing them being delivered to the heat exchanger of the boiler.

6. A connection strip according to claim 1, wherein at least one other molded module is assembled against the assembly of the four above-defined modules using the same tie bars that are used for assembling said four modules, namely a fifth module comprising an inlet connectable to pipework providing an outside feed of gas under pressure, an outlet connectable to pipework for feeding the burner of the boiler with gas, a duct connecting said inlet to said outlet, and a stopcock mounted on said duct, and optionally a sixth module for the various electrical connections of the boiler.

7. A connection strip according to claim 1, wherein each module is made of hard plastic, which plastic may differ from one module to another.

8. A connection strip according to claim 1, wherein each molded module comprises a prismatic or cylindrical peripheral band whose outline is substantially rectangular with rounded corners, four rectilinear channels being disposed in respective ones of the four corners of said band for receiving the tie bars, and a plurality of rectilinear or bent tubular lengths reinforced by generally plane webs extending perpendicularly to the generator lines of the prism of cylinder defining the band.

9. A connection strip according to claim 1, wherein the inlets or outlets for connection to the boiler are all disposed on a top face of the strip, and wherein most of the inlets or outlets for connection to external pipework are disposed on the rear face of the strip.

* * * * *